US005445909A

United States Patent [19]

Akasaki et al.

[11] Patent Number: 5,445,909

[45] Date of Patent: Aug. 29, 1995

[54] ELECTROPHOTOGRAPHIC PHOTORECEPTOR

[75] Inventors: Yutaka Akasaki; Katsuhiro Sato; Katsumi Nukada, all of Kanagawa, Japan

[73] Assignee: Fuji Xerox Co., Ltd., Tokyo, Japan

[21] Appl. No.: 88,577

[22] Filed: Jul. 9, 1993

Related U.S. Application Data

[63] Continuation of Ser. No. 767,797, Sep. 30, 1991, abandoned.

[30] Foreign Application Priority Data

Oct. 19, 1990 [JP] Japan ..... 2-283111

[51] Int. Cl.[6] ..... G03G 15/02

[52] U.S. Cl. ..... 430/58; 430/59; 430/73; 430/74; 430/75; 430/78

[58] Field of Search ..... 430/73, 74, 75, 78, 430/59, 58

[56] References Cited

U.S. PATENT DOCUMENTS 4,508,803 4/1985 Law et al. ..... 430/59
4,552,822 11/1985 Kazmaier et al. ..... 430/59
4,624,904 11/1986 Kazmaier et al. ..... 430/59
4,948,687 8/1990 Murase et al. ..... 430/58
4,988,595 1/1991 Pai et al. ..... 430/59
5,004,661 4/1991 Law et al. ..... 430/59
5,047,589 9/1991 Akasaki et al. ..... 564/307

*Primary Examiner*—S. Rosasco
*Attorney, Agent, or Firm*—Finnegan, Henderson, Farabow, Garrett & Dunner

[57] ABSTRACT

An electrophotographic photoreceptor high in sensitivity and contrast potential after light irradiation is disclosed. The photoreceptor comprises an electroconductive substrate having thereon a photoconductive layer comprising a charge generating layer comprising a charge generating material, and a charge transporting layer comprising a charge transporting material, wherein the ionization potential IPg of the charge generating material is lower than the ionization potential IPt of the charge transporting material, the difference therebetween is 0.35 eV or less, and the difference between the ionization potential IPg1 of the charge generating layer and the ionization potential IPt1 of the charge transporting layer is within the range of −0.1 to +0.1 eV.

7 Claims, No Drawings

ELECTROPHOTOGRAPHIC PHOTORECEPTOR

This application is a continuation of application Ser. No. 07/767,797, filed Sep. 30, 1991, now abandoned.

FIELD OF THE INVENTION

The present invention relates to an electrophotographic photoreceptor comprising a substrate, a charge generating layer and a charge transporting layer, and more particularly to an electrophotographic photoreceptor comprising improved charge generating and charge transporting layers.

BACKGROUND OF THE INVENTION

As to electrophotographic photoreceptors using photoconductive materials as photosensitive materials, the photoreceptors have previously been known in which inorganic photoconductive materials such as selenium and zinc oxide and various organic photoconductive materials are used as the photoconductive materials. Of these photoreceptors, a function separation type electrophotographic photoreceptor in which a photosensitive layer is separated into a charge generating layer and a charge transporting layer has rapidly advanced in recent years, because the sensitivity which is a major factor for photoreceptors using conventional organic photoconductive materials can be significantly improved.

As means for improving the sensitivity of a photoreceptor, it is reported that the sensitivity increases with a decrease in the ionization potential IPt1 of the charge transporting layer when the ionization potential IPg1 of the charge generating layer is higher than the ionization potential IPt1 of the charge transporting layer in the case of the negative charge type photoreceptors (refer to *Chemistry and Industry* (Kagaku To Kogyo), No.34, Vol. 7, 489–492 (1981)). Further, JP-A-60-207142 (the term "JP-A" as used herein means an "unexamined published Japanese patent application") discloses that a photoreceptor is highly sensitized by the use of a phthalocyanine powder and a charge transporting material having an ionization potential of 6.1 to 6.7. Furthermore, JP-A-1-219752 discloses that a photoreceptor is highly sensitized by the use of a charge generating layer and a charge transporting layer in which the difference between the ionization potential IPt1 of the charge transporting layer and the ionization potential IPg1 of the charge generating layer (IPt1-IPg1) is ±0.14 to 0.26 eV, namely the ionization potential of the charge transporting layer is higher than that of the charge generating layer by a value within the specified range.

In the method proposed in the above-described *Chemistry and Industry*, however, the ionization potential of the charge generating material is established more highly than that of the charge transporting material. Hence, although the residual potential of the photoreceptor decreases to improve the sensitivity, the lowering rate of the surface potential of the photoreceptor until light irradiation after initial charging, namely the dark decay ratio, increases at the same time. As a result, the photoreceptor has the disadvantage that the contrast potential after light irradiation is insufficient.

The photoreceptors produced by the methods described in JP-A-60-207142 and JP-A-1-219752 exhibit a sensitivity good to some extent, but the residual potential increases, so that the photoreceptors have the disadvantage that the contrast potential after light irradiation is insufficient, also.

SUMMARY OF THE INVENTION

The present invention has been made contemplating the above-described facts. An object of the present invention is therefore to provide an electrophotographic photoreceptor high in sensitivity due to the rapid injection of charges from a charge generating layer into a charge transporting layer following light irradiation, and high in contrast potential after light irradiation due to low dark decay ratio and residual potential after initial charging.

As a result of their studies, the present inventors discovered that the above-described object can be attained by an electrophotographic photoreceptor having specific relationships between the ionization potential of a charge generating material and that of a charge transporting material, and between the ionization potential of a charge generating layer and that of a Charge transporting layer, thus completing the present invention.

According to the present invention, there is provided an electrophotographic photoreceptor comprising an electroconductive substrate having thereon a photoconductive layer comprising a charge generating layer comprising a charge generating material and a charge transporting layer comprising a charge transporting material, wherein the ionization potential IPg of the charge generating material is lower than the ionization potential IPt of the charge transporting material, the difference therebetween is 0.35 eV or less, and the difference between the ionization potential IPg1 of the charge generating layer and the ionization potential IPt1 of the charge transporting layer is within the range of −0.1 to ±0.1 eV.

DETAILED DESCRIPTION OF THE INVENTION

The present invention will hereinafter be described in detail.

An electrophotographic photoreceptor of the present invention comprises an electroconductive substrate, a charge generating layer and a charge transporting layer. Known materials can be used for the conductive substrates. Such materials include drums of metals such as aluminum, copper, iron and nickel; sheets, paper, plastics and glass over which metals such as aluminum, copper, gold, silver, platinum, palladium, titanium, nickel-chromium, stainless steel and copper-indium are deposited or which are laminated with metal foil; and drum-like, sheet-like and plate-like materials subjected to a conductive treatment by applying binder resins in which carbon black, indium oxide, tin oxide-antimony oxide powders, metal powders or the like are dispersed. Further, the surfaces of the conductive substrates may be subjected to oxidation treatment or coloring treatment, or light absorbing layers or light scattering layers may be formed thereon to prevent interference fringes, as required. Between the conductive substrates and the photoconductive layers, undercoat layers may be further formed which are composed of organic polymer compounds such as acrylic resins, polyamide resins, vinyl chloride-vinyl acetate copolymers and polyvinyl alcohol, or inorganic polymer compounds such as dry hardened products of zirconium chelate compounds.

In the present invention, either of the charge generating layer and the charge transporting layer may be formed on the conductive substrate. When the charge generating layer is formed on the conductive substrate and the charge transporting layer formed on the charge generating layer has hole transporting properties, the photoreceptor is usually used as a negative charge type. The charge generating layers are formed by dispersing charge generating materials such as charge generating pigments into electrically active or inactive polymer matrices known in the art. The charge generating materials include selenium, selenium-tellurium, pyrylium dyes, thipopyrylium dyes, anthanthrone series polycyclic quinone pigments, perylene pigments, perinone pigments, monoazo pigments, bisazo pigments, trisazo pigments, squarylium pigments and various crystalline phthalocyanine pigments. Of these, the charge generating pigments having hole transporting properties and an absolute ionization potential of 4.9 to 5.4 eV are particularly preferable because the ionization potential relations of the present invention are easily satisfied. Herein, to decide whether the charge generating material has hole transporting properties or not, a method is used in which the charge generating material is deposited over a substrate, or the material dispersed in a resin at a high concentration (50–90 wt %) is applied to a substrate, and it is charged positively or negatively, followed by measurement of light decay. A charge generating material having hole transporting properties means a material whose light decay when positively charged is larger than that when negatively charged in the above-described method. The squarylium pigments, the phthalocyanine pigments and the perylene pigments are the charge generating pigments having hole transporting properties and an ionization potential of 4.9 to 5.4 eV, and examples of these compounds are shown below. The squarylium pigments include compounds represented by the following general formula (I):

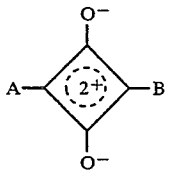

(I)

where A and B each represent the following formulae:

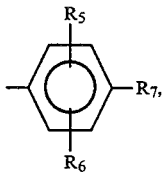

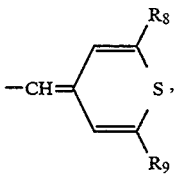

-continued

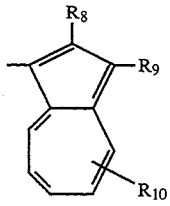

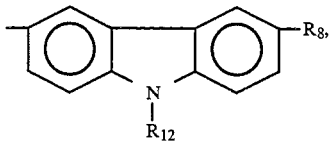

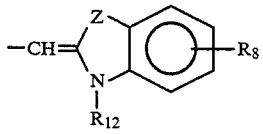

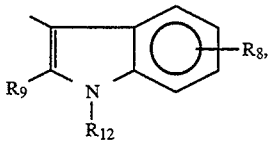

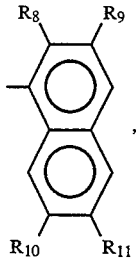

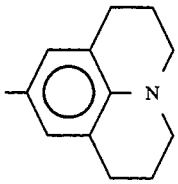

wherein $R_5$ and $R_6$ each represent a hydrogen atom, a hydroxyl group, a fluorine atom, an alkyl group having from 1 to 4 carbon atoms, $—NR_{13}R_{14}$ (wherein $R_{13}$ and $R_{14}$ each represent a hydrogen atom, an alkyl group having from 1 to 4 carbon atoms, an aryl group having from 6 to 14 carbon atoms, an aralkyl group having from 7 to 15 carbon atoms, an alkylcarbonyl group having from 2 to 5 carbon atoms or an arylcarbonyl group having from 7 to 15 carbon atoms), an alkoxy group having from 1 to 4 carbon atoms or an aryloxy group having from 6 to 14 carbon atoms; $R_7$ represents $—NR_{15}R_{16}$ (wherein $R_{15}$ and $R_{16}$ each represent an alkyl group having from 1 to 4 carbon atoms, an aryl group having from 6 to 14 carbon atoms or an aralkyl group having from 7 to 15 carbon atoms which may be substituted with a halogen atom such as chlorine, and $R_{15}$ and $R_{16}$ may be combined with each other to form a ring); $R_8$, $R_9$, $R_{10}$ and $R_{11}$ each represent a hydrogen atom, an alkyl group having from 1 to 4 carbon atoms, an aryl group having from 6 to 14 carbon atoms, $—CONHR_{17}$ (wherein $R_{17}$ represents an alkyl group having from 1 to 4 carbon atoms, an aryl group having from 6 to 14 carbon atoms or an aralkyl group having from 7 to 15 carbon atoms), a halogen atom, an alkoxy group having from 1 to 4 carbon atoms or an aryloxy group having from 6 to 14 carbon atoms; $R_{12}$ represents an alkyl group having from 1 to 4 carbon atoms, an aryl group having from 6 to 14 carbon atoms or an aralkyl group having from 7 to 15 carbon atoms; and Z represents $>CR_{18}R_{19}$, —S— and $—CR_{18}=CR_{19}—$ (wherein $R_{18}$ and $R_{19}$ each represent a hydrogen atom, an alkyl group having from 1 to 4 carbon atoms, an aryl group having from 6 to 14 carbon atoms or an aralkyl group having from 7 to 15 carbon atoms).

Specific examples thereof include the following compounds:

I-1
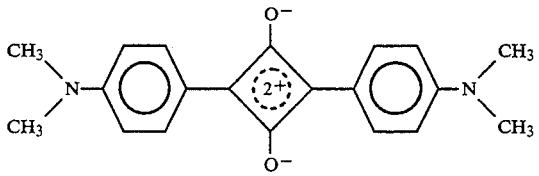
I-2
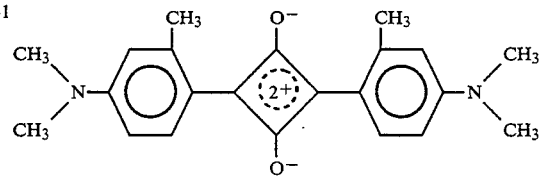
I-3
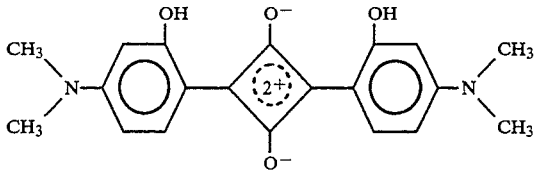
I-4
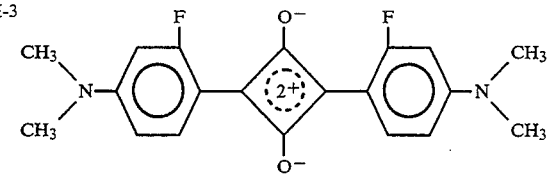
I-5
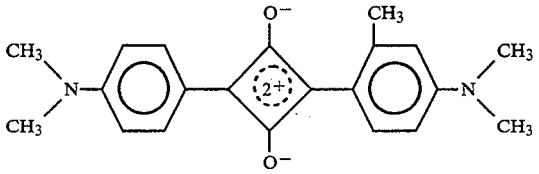
I-6
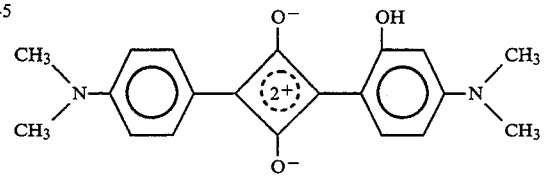
I-7
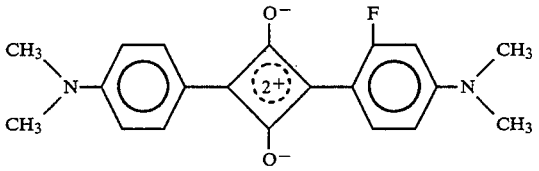
I-8
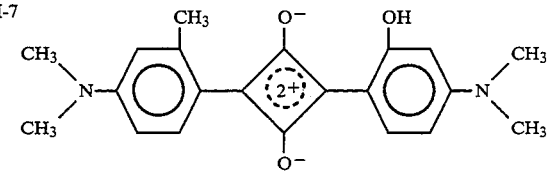
I-9
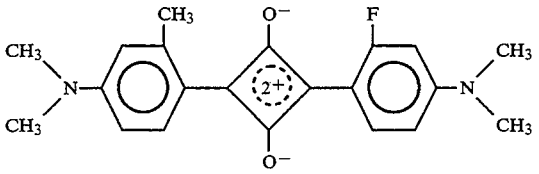
I-10
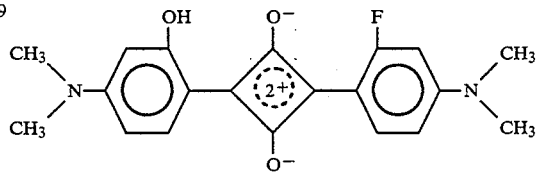
I-11
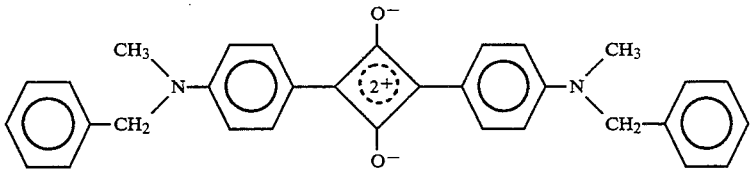
I-12
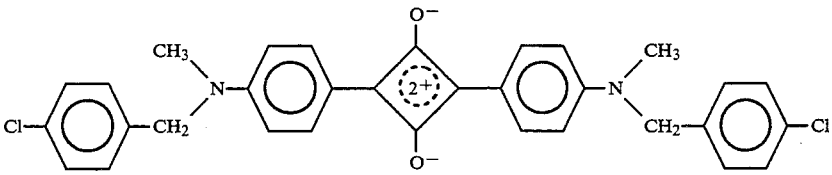
I-13
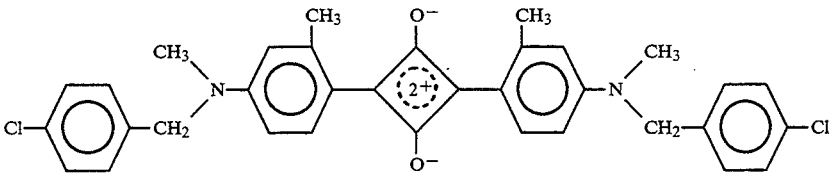
I-14
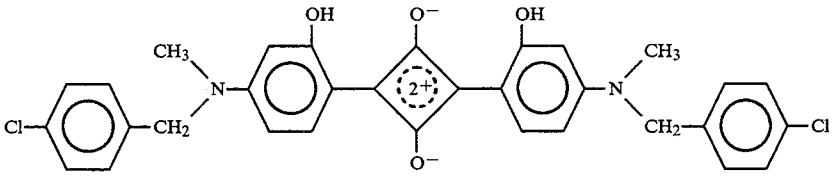

-continued
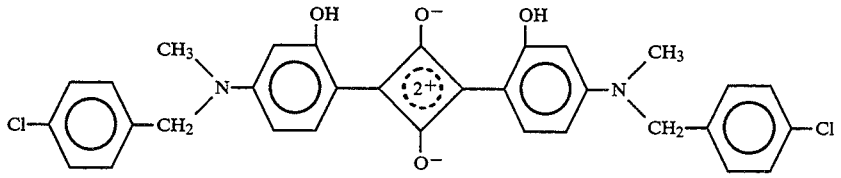
I-15
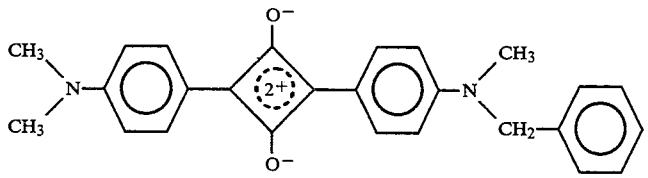
I-16
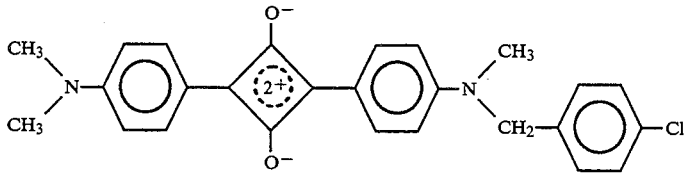
I-17
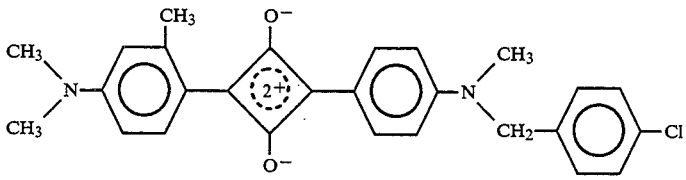
I-18
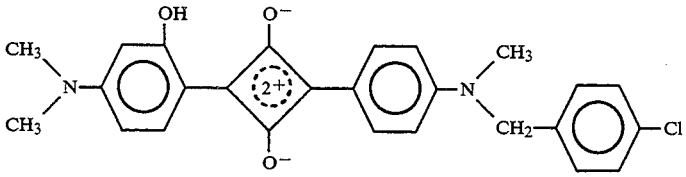
I-19
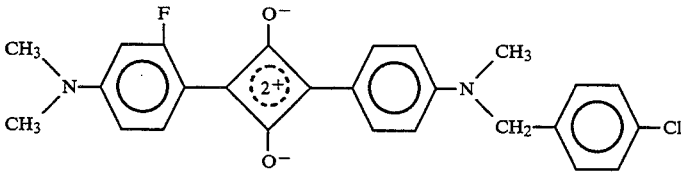
I-20
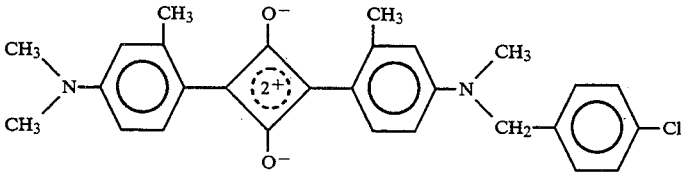
I-21
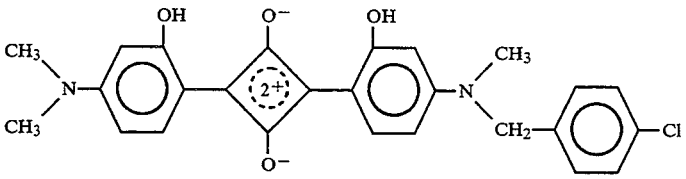
I-22

-continued
I-23
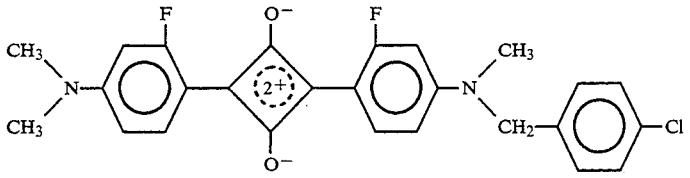
I-24
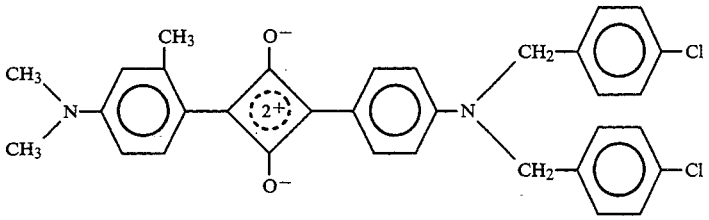
I-25
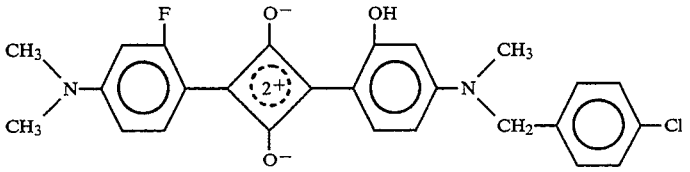
I-26
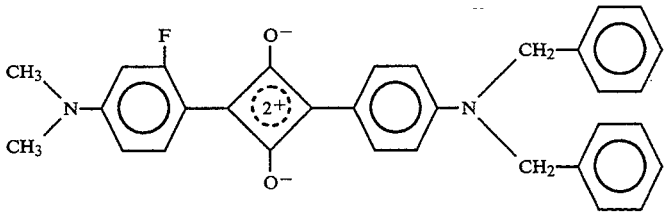
I-27
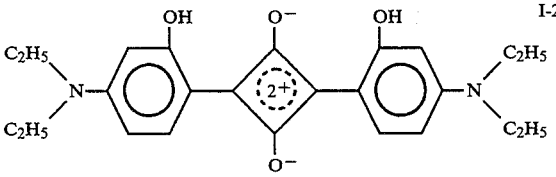
I-28
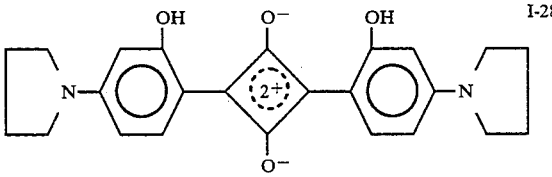
I-29
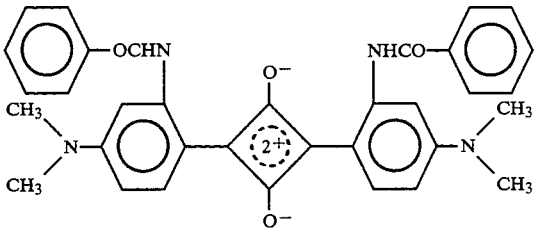
I-30
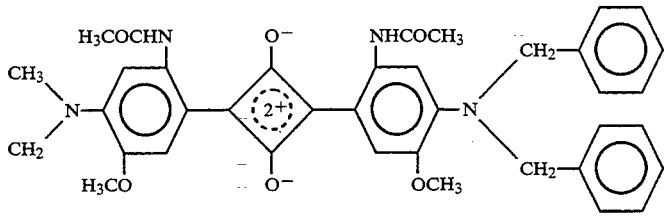

-continued
I-31
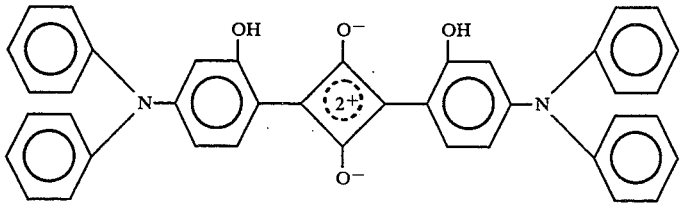
I-32
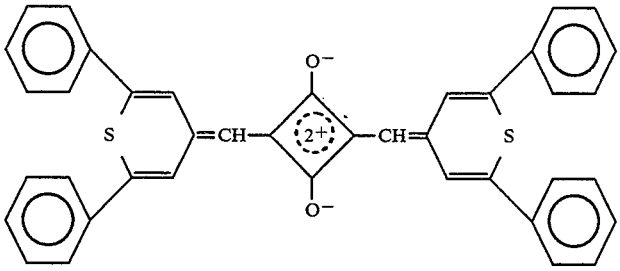
I-33
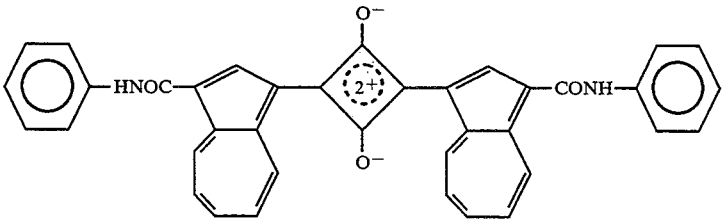
I-34
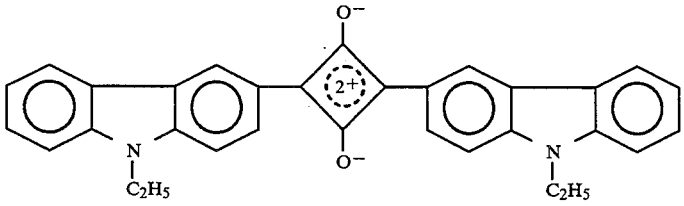
I-35
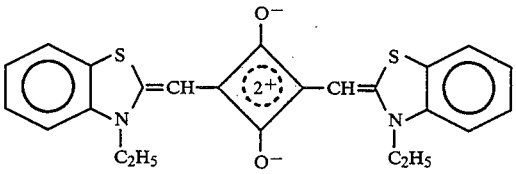
I-36
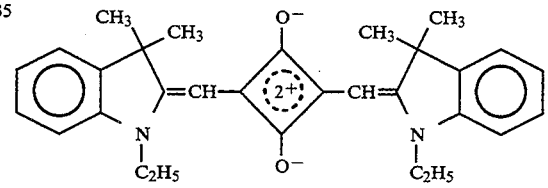
I-37
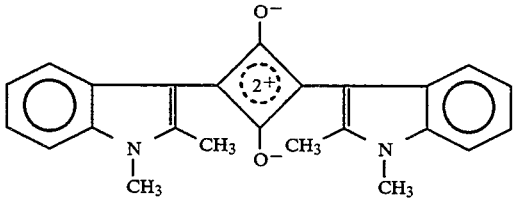
I-38
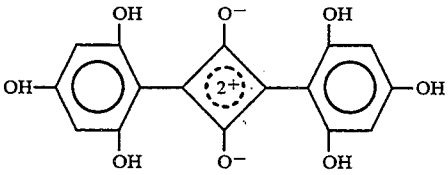
I-39
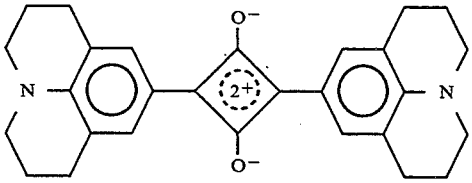
I-40
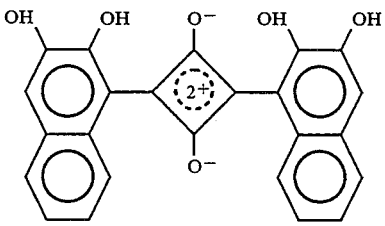

-continued

I-41

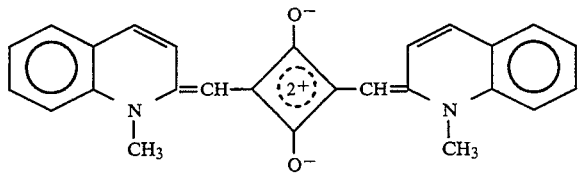

The phthalocyanine pigments include compounds represented by the following general formula (II):

(II)

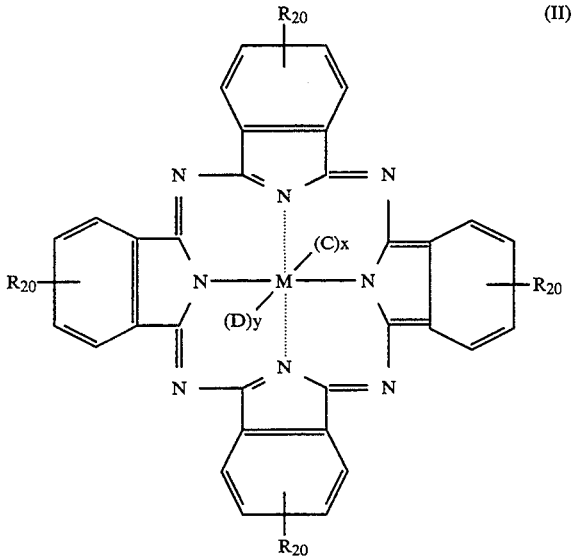

wherein $R_{20}$ represents a hydrogen atom, an alkyl group having from 1 to 5 carbon atoms, an aryl group having from 6 to 14 carbon atoms, an aralkyl group having from 7 to 15 carbon atoms, a halogen atom, a cyano group or a nitro group; M represents two hydrogen atoms or a metal atom selected from Cu, Ni, Co, Fe, Mn, Cr, Ti, Ru, Pd, In, Sn, Sb, Zn, Mg, Ga, Ge, As, Si, Hg, Ti, V, U and Pd; C and D each represent a halogen atom or an oxygen atom; and x and y each represent 0 or 1, with the condition that when M is a divalent metal atom, both x and y are 0; when M is a trivalent metal atom, x and y are 1 and 0, respectively; when M is a tetravalent metal atom, both x and y are 1; when M is V, C is an oxygen atom, and x and y are 1 and 0, respectively; and when M is U, C and D are oxygen atoms, and both x and y are 1.

Specific examples thereof include metal-free phthalocyanines, copper phthalocyanine, vanadyl phthalocyanine, oxytitanium phthalocyanine, aluminum phthalocyanine, gallium phthalocyanine, indium phthalocyanine, thallium phthalocyanine, silicon phthalocyanine, germanium phthalocyanine, tin phthalocyanine, lead phthalocyanine and halides of the above-described phthalocyanines.

The perylene pigments include, for example, compounds represented by the following general formula (III): wherein $R_{12}$ represents an alkyl group, an aryl group or an aralkyl group which may be substituted.

Specific examples thereof include the following compounds:

(III)

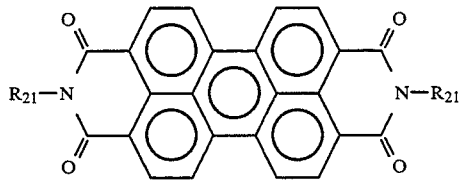

wherein $R_{21}$ represents an alkyl, aryl or aralkyl group which may be substituted with, for example, a halogen atom, an alkyl group, an alkoxy group or an aralkyl group.

Specific examples thereof include the following compounds:

III-1

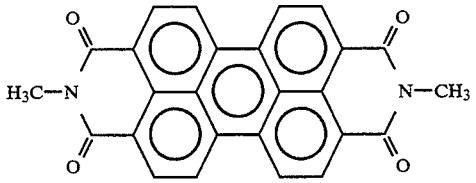

III-2

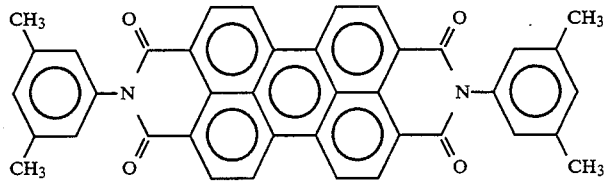

-continued

III-3

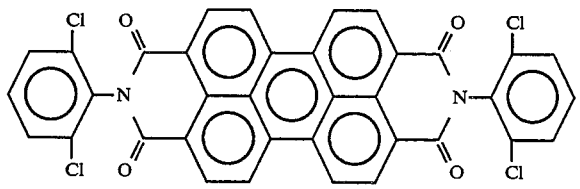

III-4

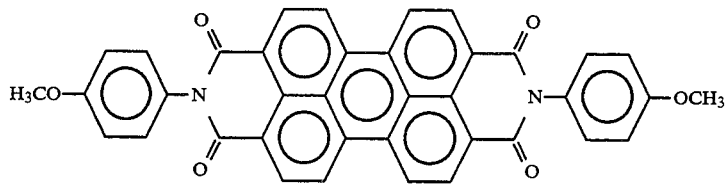

III-5

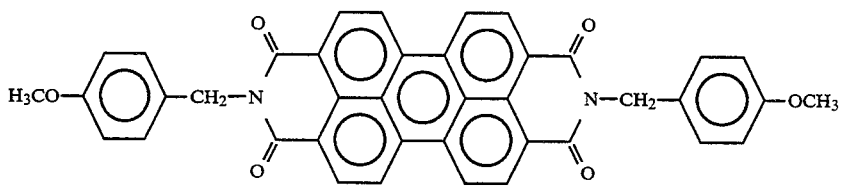

Polymer matrices for dispersing the above-described charge generating pigments include known inactive matrix materials such as polyvinyl butyral resins, polyallylate resins, polystyrene resins, silicone resins, polycarbonate resins, acrylic resins, methacrylic resins, polyester resins, cellulose resins and alkyd resins, as well as active polymer materials such as polyvinylcarbazole.

The charge generating pigments are preferably compounded in an amount of 0.1 to 10 parts by weight per part by weight of binder resin. When the charge generating pigments are dispersed, the use of the charge generating pigments having a mean particle size of 3 μm or less, preferably 0.5 μm or less is effective. The film thickness of the charge generating layers is generally established within the range of 0.05 to 5 μm, and preferably within the range of 0.1 to 2 μm.

Coating methods which can be used when the charge generating layers are formed include a blade coating method, a wire bar coating method, a spray coating method, a dip coating method, a bead coating method, an air knife coating method and a curtain coating method. As solvents for preparing the charge generating layers, solvents such as methanol, ethanol, n-propanol, n-butanol, benzyl alcohol, methyl cellosolve, ethyl cellosolve, acetone, methyl ethyl ketone, cyclohexanone, methyl acetate, dioxane, tetrahydrofuran, methylene chloride and chloroform can be used alone or as mixtures of at least two kinds of them.

The charge transporting layers used in the electrophotographic photoreceptors of the present invention are formed by incorporating charge transporting materials in appropriate polymer matrices. The charge transporting materials used are required to have a ionization potential IPt higher than the ionization potential IPg of the charge generating materials, and the difference therebetween must be 0.35 eV or less, preferably 0.3 eV or less. Further, the difference between the ionization potential IPtl of the charge transporting layers containing the charge transporting materials and the ionization potential IPgl of the charge generating layers is required to be between −0.1 eV and +0.1 eV. These charge transporting materials and charge generating materials are sometimes dissolved or dispersed in the matrix materials to form the photoreceptors. In some cases, the ionization potential of the layers formed of the charge generating materials dissolved or dispersed in the matrix materials is somewhat different from that of the layers formed of the charge generating materials alone. Also in such cases, the difference between the ionization potential IPtl of the charge transporting layers and the ionization potential IPgl of the charge generating layers is required to be between −0.1 eV and +0.1 eV. If the charge generating materials, the charge generating layers, the charge transporting materials and the charge transporting layers do not satisfy these relationships, the residual potential of the photoreceptors is elevated to reduce the sensitivity of the photoreceptors or to increase the dark decay ratio thereof, which results in the failure to obtain high contrast images. When the layers are formed, therefore, it is necessary to select the materials, giving attention to fluctuations in the ionization potential value.

The ionization potential is described below. A sample is prepared, and light emitted from an ultraviolet lamp to the sample is dispersed by a monochromator. When the surface of the sample is scanned from a portion low in excitation energy to a portion high in excitation energy, electron emission due to photoelectric effect is initiated by light having a certain wavelength. A value obtained by energy conversion of the wavelength at which this electron emission is initiated is called the ionization potential, and this value is defined as the ionization potential in this invention. Such measurement can be easily carried out by the use of, for example, a surface analyzer (for example, Type AC-1 (trade name), manufactured by Riken Keiki Co., Ltd.). In measuring each ionization potential, it is possible to cope with it by selecting a sample form.

In the present invention, various compounds are used as the charge transporting materials. Examples of such compounds include oxadiazole derivatives such as 2,5-bis(p-diethylaminophenyl)-1,3,4-oxadiazole; pyrazoline derivatives such as 1,3,5-triphenylpyrazoline; aromatic tertiary amino compounds such as triphenylamine and dibenzylaniline; aromatic tertiary diamino compounds such as N,N'-diphenyl-N,N'-di(p-ethylphenyl)-1,1'-diphenyl-4,4'-diamine; 1,2,4-triazine derivatives such as 3-(4'-dimethylaminophenyl)-5,6-di(4'-methoxyphenyl)-1,2,4-triazine; hydrazone derivatives such as 4-diethylaminobenzaldehyde-1,1'-diphenylhydrazone; quinazoline derivatives such as 2-phenyl-4-styrylquinazoline; benzofuran derivatives such as 6-hydroxy-2,3-di(-methoxyphenyl)benzofuran; α-stilbene derivatives such as p-(2,2'-diphenylvinyl)-N,N'-diphenylaniline; and enamine derivatives. In particular, the charge transporting materials having a charge mobility of $4\times10^{-6}$ $cm^2/V.sec$ or more and an absolute ionization potential of 5.0 to 5.5 eV are preferably used because it becomes possible to further heighten the sensitivity, and the relationships of the ionization potential are easily established within the above-described ranges.

Here, the charge mobility means a value measured at a concentration of the charge transporting material of 50% by weight at an electric field strength of 30 V/μm by the TOF (time of flight) method, and is defined by the travelling speed of charge carriers per unit electric field in the charge transporting layer. In measuring it, the charge transporting layer is formed similarly with the method of forming the usual charge transporting layer on an NESA glass, and Au electrodes are provided to form an electric field. Charges transferred when ultraviolet light of 380 nm is irradiated from a monochromator are accumulated in a capacitor, and the amount thereof is measured. The charge mobility is obtained by calculating the results measured (for the details, refer to JP-A-2-195041).

As the polymer matrix materials for charge transporting layers, known resins can be used. Such compounds include but are not limited to polycarbonate resins, polyester resins, polyallylate resins, methacrylic resins, acrylic resins, vinyl chloride resins, vinylidene chloride resins, polystyrene resins, polyvinyl acetal resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins and styrene-alkyd resins. These binder resins can be used alone or as mixtures of at least two kinds of them.

The mixing ratio of the charge transporting material to the binder resin is preferably 10:1 to 1:5 (ratio by weight). The film thickness of the charge transporting layers used in the present invention is established generally within the range of 5 to 60 μm, and preferably within the range of 10 to 40 μm.

Coating methods for forming the charge transporting layers include a blade coating method, a wire bar coating method, a spray coating method, a dip coating method, a bead coating method and a curtain coating method. Further, as solvents used when the charge transporting layers are formed, organic solvents such as aromatic hydrocarbons such as benzene, toluene, xylene and chlorobenzene; ketones such as acetone and 2-butanone; halogenated aliphatic hydrocarbons such as methylene chloride, chloroform and ethylene chloride; and cyclic or straight chain ethers such as tetrahydrofuran and ethyl ether may be used alone or as mixtures of at least two kinds of them.

For the electrophotographic photoreceptors of the present invention, it is also possible to further provide surface protective layers to prevent a reduction in mechanical strength or chemical deterioration of the photosensitive layers. As the protective layers, those having insulating properties or low resistance can be used.

The electrophotographic photoreceptors of the present invention will hereinafter be described by examples and comparative examples.

EXAMPLE 1

A mixture solution having the following composition was prepared to form a charge generating layer on an aluminum sheet.

| | |
|---|---|
| Polyvinyl butyral resin (trade name: BLX, manufactured by Sekisui Chemical Co., Ltd.) | 1 part by weight |
| Cyclohexane | 40 parts by weight |
| Example compound I-6 (IPg = 5.05 eV) | 10 parts by weight |

The above-described mixture was sufficiently dispersed with a paint shaker, and applied with an applicator, followed by drying to form a charge generating layer having a dry film thickness of 0.5 μm. Then, the ionization potential (IPg1) of this charge generating layer was measured using a surface analyzer (AC-1, manufactured by Riken Keiki Co., Ltd.). As a result, IPg1 was 5.12 eV. Thereafter, a mixture solution for forming a charge transporting layer, the mixture solution having the following composition, was prepared.

| | |
|---|---|
| Polycarbonate resin (trade name: Lexan 145, manufactured by General Electric Co.) | 1 part by weight |
| Dichloromethane | 15 parts by weight |
| The following compound (a) | 1 part by weight |

(a)

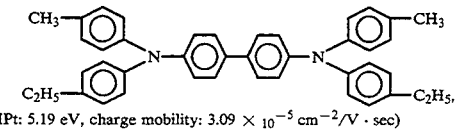

(IPt: 5.19 eV, charge mobility: $3.09\times10^{-5}$ $cm^{-2}/V\cdot sec$)

This homogeneous mixture was applied to the above-described charge generating layer with an applicator, followed by drying to form a charge transporting layer. At the same time, a glass plate was similarly coated with the above-described mixture solution for forming the charge transporting layer, followed by drying. The ionization potential of the resulting coating film was measured using the surface analyzer described above. As a result, IPt1 was 5.15 eV.

The electrophotographic photoreceptor thus produced was subjected to corona discharge of −6 KV to charge it negatively and uniformly, and the surface potential Vd was measured after standing in the dark at the charge potential $V_0$ for 1 second, using an electrostatic process copying paper test device (SP-428, manufactured by Kawaguchi Denki Seisakusyo). Then, the surface of the photoreceptor was irradiated with light using a tungsten lamp so as to give a surface illuminance of 5 luxes, and the initial sensitivity (dV/dT (V/sec)), the contrast potential 1 second after light irradiation (Vc), and the residual potential 10 seconds after light irradiation ($V_{RP}$) were measured. Further, the dark decay ratio DDR was determined by calculation, based on the equation: $DDR=100\times(V_0-Vd)/V_0$. The results are shown in Table 1.

EXAMPLES 2 TO 6

Electrophotographic photoreceptors were produced in the same manner as in Example 1 with the exception that the charge generating material and the charge transporting material were changed as shown in Table 1, and similarly evaluated. The results are shown in Table 1.

COMPARATIVE EXAMPLES 1 TO 6

Electrophotographic photoreceptors were produced in the same manner as in Example 1 with the exception that the charge generating material and the charge transporting material were changed as shown in Table 1, and similarly evaluated. The results are shown in Table 1.

TABLE 1

| | Charge Transporting Material | Charge Mobility | Charge Generating Material | IPt-IPg | IPtl-IPgl |
|---|---|---|---|---|---|
| Ex. 1 | (a) | $3.09 \times 10^{-5}$ | I-6 | +0.14 | +0.03 |
| Ex. 2 | (b) | $2.20 \times 10^{-5}$ | II-3 | +0.14 | +0.07 |
| Ex. 3 | (b) | $2.20 \times 10^{-5}$ | I-25 | +0.08 | −0.01 |
| Ex. 4 | (b) | $2.20 \times 10^{-5}$ | I-10 | +0.14 | +0.01 |
| Ex. 5 | (c) | $1.03 \times 10^{-5}$ | I-19 | +0.17 | +0.04 |
| Ex. 6 | (d) | $2.01 \times 10^{-5}$ | I-24 | +0.21 | +0.03 |
| Comp. Ex. 1 | (e) | $2.51 \times 10^{-5}$ | I-12 | +0.39 | +0.29 |
| Comp. Ex. 2 | (f) | $2.80 \times 10^{-5}$ | II-3 | +0.67 | +0.48 |
| Comp. Ex. 3 | (g) | $6.83 \times 10^{-5}$ | I-15 | +0.43 | +0.35 |
| Comp. Ex. 4 | (d) | $2.01 \times 10^{-5}$ | I-6 | +0.40 | +0.21 |
| Comp. Ex. 5 | (h) | $1.52 \times 10^{-5}$ | I-12 | −0.06 | −0.15 |
| Comp. Ex. 6 | (a) | $3.09 \times 10^{-5}$ | I-25 | −0.02 | −0.12 |

| | $V_0$ | DDR | dV/dT | Vc | $V_{RP}$ |
|---|---|---|---|---|---|
| Ex. 1 | 800 | 8 | 1640 | 530 | 0 |
| Ex. 2 | 910 | 7 | 770 | 310 | 20 |
| Ex. 3 | 790 | 9 | 1670 | 520 | 0 |
| Ex. 4 | 850 | 6 | 1600 | 550 | 0 |
| Ex. 5 | 870 | 5 | 1580 | 510 | 5 |
| Ex. 6 | 890 | 3 | 1510 | 480 | 10 |
| Comp. Ex. 1 | 950 | 7 | 1550 | 400 | 45 |
| Comp. Ex. 2 | 1100 | 4 | 620 | 280 | 100 |
| Comp. Ex. 3 | 1020 | 4 | 1510 | 375 | 60 |
| Comp. Ex. 4 | 990 | 5 | 1580 | 390 | 55 |
| Comp. Ex. 5 | 625 | 15 | 1730 | 330 | 0 |
| Comp. Ex. 6 | 650 | 12 | 1700 | 340 | 0 |

(b)

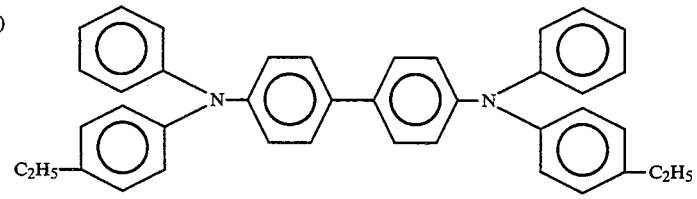

(c)

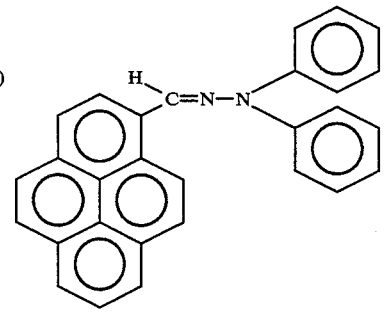

(d)

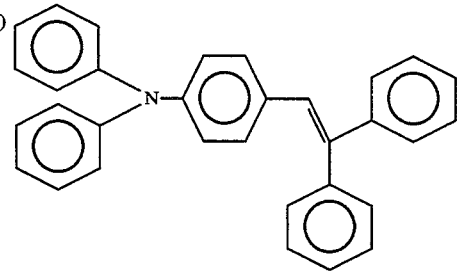

TABLE 1-continued (e)

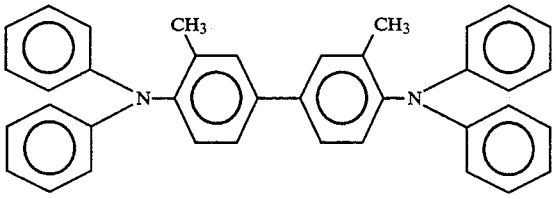

(f)

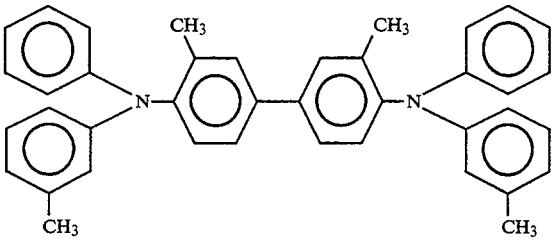

(g)

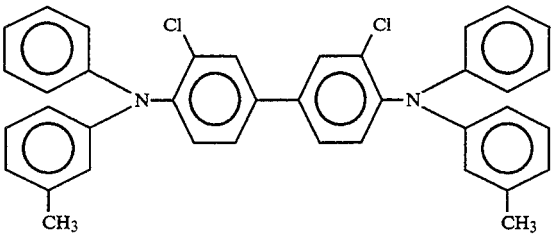

(h)

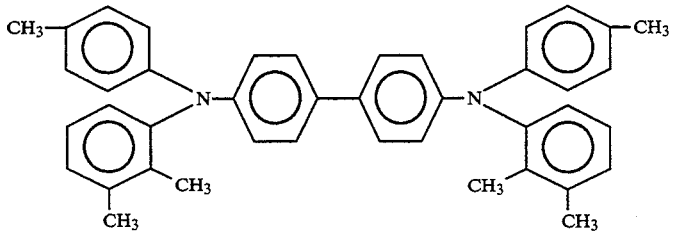

In the electrophotographic photoreceptors of the present invention, the relationship between the ionization potential of the charge generating materials and that of charge transporting materials, and the relationship between the ionization potential of the charge generating layers and that of the charge transporting layers are each specified as described above. The electrophotographic photoreceptors therefore have the effects of being high in sensitivity due to the rapid injection of charges from the charge generating layers into the charge transporting layers upon light irradiation, and being high in contrast potential after light irradiation due to low dark decay ratio and residual potential after initial charging. If the ionization potential of the charge transporting materials is too much higher than that of the charge generating materials, it becomes difficult to establish the relationship between the ionization potential of the charge generating layers and that of the charge transporting layers within the above-described range, which causes the residual potential of the photoreceptors to increase. Consequently, sufficient electrostatic contrast can not be obtained, and the sensitivity is also insufficient. On the other hand, if the ionization potential of the charge generating materials is higher than that of the charge transporting materials, it becomes difficult to establish the relationship between the ionization potential of the charge generating layers and that of the charge transporting layers within the above-described range, which causes the dark decay ratio of the photoreceptors to increase. As a result, sufficient electrostatic contrast can not be obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising an electroconductive substrate having thereon a photoconductive layer comprising a charge generating layer comprising a charge generating material and a charge transporting layer comprising a charge transporting material, wherein the ionization potential of said charge generating material is lower than the ionization potential of said charge transporting material, the difference between the ionixation potentials is 0.35 eV or less, and the difference the ionization potential of said charge generating layer and the ionization potential of said charge transporting layer is within the range of −0.1 to ±0.1 eV, and wherein said charge transporting material is:

(a)

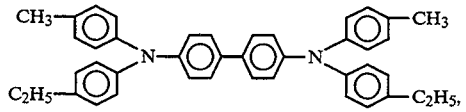

(b)

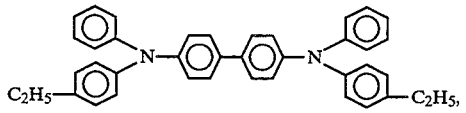

(c)

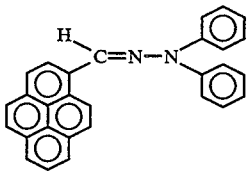

OR (d)

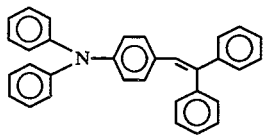

2. The electrophotographic photoreceptor of claim 1, wherein said charge generating material is a charge generating pigment having hole transporting properties and an absolute ionization potential of from 4.9 to 5.4 eV.

3. The electrophotographic photoreceptor of claim 1, wherein said charge generating layer has a film thickness of from 0.05 to 5 μm.

4. The electrophotographic photoreceptor of claimed 1, wherein the difference between the ionization potential IPg of said charge generating material and the ionization potential IPt of said charge transporting material is 0.30 eV or less.

5. The electrophotographic photoreceptor of claim 1, wherein said charge transporting layer has a film thickness of from 5 to 60 μm.

6. The electrophotographic photoreceptor of claim 5, wherein said charge generating material is a phthalocyanine compound represented by the general formula (II)

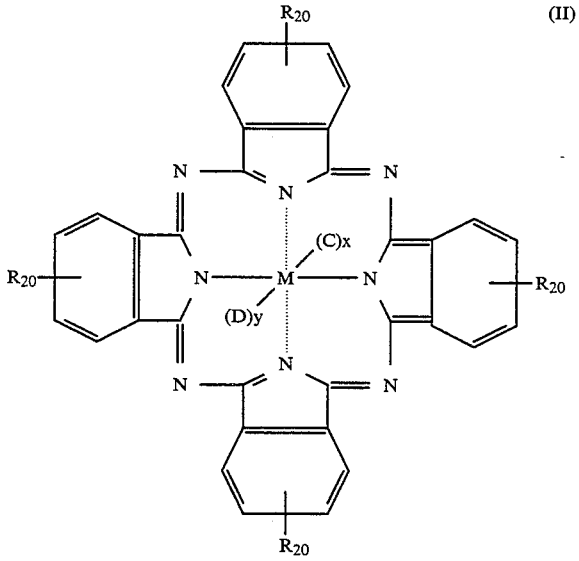

or a perylene compound represented by the following general formula:

(III)

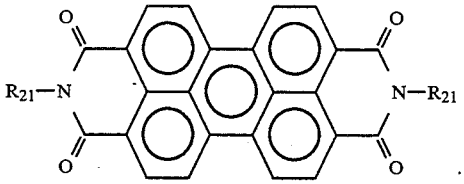

7. An electrophotographic photoreceptor comprising an electroconductive substrate having thereon a photoconductive layer comprising a charge generating layer comprising a charge generating material, and a charge transporting layer comprising a charge transporting material, wherein the ionization potential of said charge generating material is lower than the ionization potential of said charge transporting material, the difference between the ionization potentials is 0.35 eV or less, and the difference between the ionization potential of said charge generating layer and the ionization potential of said charge transporting layer is within the range of −0.1 to ±0.1 eV, and said charge transporting material is a compound represented by the following structural formula:

(a)

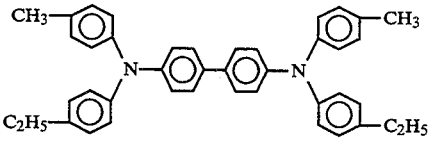

(IPt: 5.19 eV, charge mobility: $3.09 \times 10^{-5}$ $cm^{-2}/V \cdot sec$)

or (b)

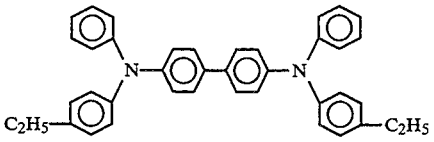

* * * * *

UNITED STATES PATENT AND TRADEMARK OFFICE

CERTIFICATE OF CORRECTION

PATENT : 5,445,909

DATED : August 29, 1995

INVENTOR(S) : Yutaka AKASAKI et al.

It is certified that error appears in the above-identified patent and that said Letters Patent is hereby corrected as shown below:

Col. 22, line 58, "material" should read --material.--.

Col. 22, line 63, "ionixation" should read --ionization--;

Col. 23, line 25, below formula (c), "OR" should read --or--.

Signed and Sealed this

Third Day of September, 1996

*Attest:*

Bruce Lehman

BRUCE LEHMAN

*Attesting Officer*

*Commissioner of Patents and Trademarks*